US008827093B1

(12) United States Patent
Mendez et al.

(10) Patent No.: US 8,827,093 B1
(45) Date of Patent: Sep. 9, 2014

(54) BOTTLE NIPPLE DEVICE

(76) Inventors: Maria A. Mendez, Miami, FL (US); Silvia M. Ramirez, Miami, FL (US)

( * ) Notice: Subject to any disclaimer, the term of this patent is extended or adjusted under 35 U.S.C. 154(b) by 691 days.

(21) Appl. No.: 12/979,670

(22) Filed: Dec. 28, 2010

(51) Int. Cl.
*A61J 11/00* (2006.01)
*A61J 9/00* (2006.01)

(52) U.S. Cl.
USPC ..... 215/11.1; 606/236; D24/195; D24/196

(58) Field of Classification Search
USPC ..... 215/387, 11.1–11.6; 220/703, 705, 711, 220/713, 717, 914, DIG. 13; 604/77, 78; 606/234–236; D24/193–199; 374/151; 446/26; D11/104
See application file for complete search history.

(56) References Cited

U.S. PATENT DOCUMENTS 1,467,904 A * 9/1923 McOmish ..... 606/236
1,620,329 A * 3/1927 Donaldson ..... 215/11.5
2,025,508 A * 12/1935 Herstein ..... 215/11.1
2,093,730 A * 9/1937 Yervant ..... 215/11.5
2,190,231 A * 2/1940 Craddock ..... 426/104
2,223,179 A * 11/1940 Lougheed ..... 215/11.1
2,316,516 A * 4/1943 Hammerstein ..... 222/490
2,388,915 A * 11/1945 Heilborn ..... 215/11.1
2,531,570 A * 11/1950 Hoffman ..... 215/11.1
2,600,978 A * 6/1952 Demarco, Jr. ..... 215/11.1
2,623,524 A * 12/1952 Clemens ..... 215/11.4
2,661,001 A * 12/1953 Alstadt et al. ..... 215/11.5
2,736,446 A * 2/1956 Raiche ..... 215/11.5
2,798,482 A * 7/1957 Feeney ..... 128/880
2,812,764 A * 11/1957 Crisp ..... 215/11.1
2,825,335 A * 3/1958 Natonek ..... 606/236
2,956,702 A * 10/1960 Ransom ..... 215/11.1
2,982,432 A * 5/1961 Mehl ..... 215/11.1
3,082,770 A * 3/1963 Straub ..... 215/11.1
3,117,450 A * 1/1964 Hoy ..... 374/151
3,272,202 A * 9/1966 Hurtado ..... 215/11.6
3,289,874 A * 12/1966 Dailey et al. ..... 215/11.6
3,301,423 A * 1/1967 Soto ..... 215/11.6
3,358,864 A * 12/1967 Meierhoefer ..... 215/11.5
3,362,555 A * 1/1968 Soto ..... 215/11.3
3,442,267 A * 5/1969 Krygier ..... 128/879
3,511,242 A * 5/1970 Agnone ..... 606/148
3,532,242 A * 10/1970 Tibbs ..... 215/11.1
3,549,036 A * 12/1970 Ritsi ..... 215/11.6
3,557,776 A * 1/1971 Boots et al. ..... 128/897
3,567,060 A * 3/1971 Ballin ..... 215/11.6
3,669,112 A * 6/1972 Mager et al. ..... 606/236
D228,333 S * 9/1973 Berger ..... D7/595
3,777,753 A * 12/1973 Kesselring et al. ..... 215/11.1
3,913,402 A * 10/1975 Doyle ..... 374/151
D255,280 S * 6/1980 Anderson ..... D1/109
RE30,526 E * 2/1981 Hurst et al. ..... 606/236
D260,866 S * 9/1981 Richards ..... D11/160
D272,613 S * 2/1984 Stewart ..... D11/160

(Continued)

*Primary Examiner* — Anthony Stashick
*Assistant Examiner* — Ned A Walker

(57) ABSTRACT

A bottle nipple device featuring a generally circular base having a top surface, a side edge, and a bottom surface; and a thumb-shaped nipple extending upwardly from the top surface of the base, the thumb-shaped nipple is generally hollow and has a top end, wherein a slot is disposed in the top end. The base is adapted to be sandwiched between a top end of a standard bottle a standard bottle cap, the standard bottle cap has a center hole that allows the nipple to protrude outwardly away from the bottle, the slot is fluidly connected to the bottom surface of the base allowing liquid to flow through the base and out of the slot.

1 Claim, 3 Drawing Sheets

(56) References Cited

U.S. PATENT DOCUMENTS

| | | | | | |
|---|---|---|---|---|---|
| D274,859 | S | * | 7/1984 | Harris et al. | D1/104 |
| D289,387 | S | * | 4/1987 | Stavola et al. | D10/109.1 |
| 4,676,386 | A | * | 6/1987 | Phlaphongphanich | 215/11.1 |
| D294,735 | S | * | 3/1988 | Morano et al. | D24/196 |
| 4,834,099 | A | * | 5/1989 | Schrooten | 215/11.1 |
| D301,835 | S | * | 6/1989 | Gorman et al. | D1/108 |
| 4,902,519 | A | * | 2/1990 | Ream et al. | 426/91 |
| D312,877 | S | * | 12/1990 | Flores | D24/195 |
| 5,013,320 | A | * | 5/1991 | Orpaz | 606/234 |
| 5,020,679 | A | * | 6/1991 | Signorini | 215/11.1 |
| 5,078,734 | A | * | 1/1992 | Noble | 604/77 |
| 5,133,740 | A | | 7/1992 | Kussick | |
| 5,180,071 | A | * | 1/1993 | Crosson | 215/11.1 |
| D335,928 | S | * | 5/1993 | Williams | D24/194 |
| 5,275,619 | A | | 1/1994 | Engebretson et al. | |
| 5,300,024 | A | * | 4/1994 | Yang | 604/73 |
| 5,379,898 | A | * | 1/1995 | Joulia | 206/528 |
| 5,391,184 | A | * | 2/1995 | Rosenthal | 606/236 |
| 5,431,680 | A | * | 7/1995 | Jones | 606/236 |
| 5,810,000 | A | * | 9/1998 | Stevens | 128/200.26 |
| 5,878,899 | A | * | 3/1999 | Manganiello et al. | 215/11.6 |
| D417,275 | S | * | 11/1999 | Conforti | D24/130 |
| D419,059 | S | * | 1/2000 | Charriez et al. | D9/624 |
| 6,041,950 | A | * | 3/2000 | Soehnlein | 215/11.1 |
| 6,228,105 | B1 | * | 5/2001 | Johansen et al. | 606/234 |
| D443,932 | S | * | 6/2001 | Wickerman | D24/196 |
| 6,470,200 | B2 | * | 10/2002 | Walker et al. | 600/344 |
| 6,500,196 | B2 | * | 12/2002 | Shattles | 606/234 |
| D475,790 | S | * | 6/2003 | Dikeman | D24/195 |
| 6,675,981 | B1 | * | 1/2004 | Lesko | 215/11.1 |
| D487,929 | S | | 3/2004 | Liu et al. | |
| 7,029,491 | B2 | | 4/2006 | Davis | |
| 7,144,416 | B2 | | 12/2006 | Struckmeier et al. | |
| D554,760 | S | | 11/2007 | Brockhaus et al. | |
| 7,780,023 | B2 | * | 8/2010 | Py et al. | 215/11.1 |
| D627,821 | S | * | 11/2010 | Patascher | D19/42 |
| D630,334 | S | * | 1/2011 | Paige | D24/196 |
| 7,931,672 | B2 | * | 4/2011 | Tesini et al. | 606/236 |
| D644,334 | S | * | 8/2011 | Py | D24/197 |
| D650,083 | S | * | 12/2011 | Sharp | D24/194 |
| D651,718 | S | * | 1/2012 | Grisham et al. | D24/195 |
| 8,251,235 | B2 | * | 8/2012 | Py et al. | 215/11.4 |
| D667,559 | S | * | 9/2012 | Py | D24/197 |
| 8,376,003 | B2 | * | 2/2013 | Py et al. | 141/330 |
| 2001/0029324 | A1 | * | 10/2001 | Walker et al. | 600/323 |
| 2002/0028990 | A1 | * | 3/2002 | Shepherd et al. | 600/340 |
| 2003/0181947 | A1 | * | 9/2003 | Struckmeier et al. | 606/234 |
| 2006/0036285 | A1 | * | 2/2006 | Davis | 606/234 |
| 2007/0238063 | A1 | | 10/2007 | Tesini et al. | |
| 2007/0283666 | A1 | * | 12/2007 | Py et al. | 53/425 |
| 2009/0139883 | A1 | * | 6/2009 | Py et al. | 206/219 |
| 2010/0268276 | A1 | * | 10/2010 | Du Chesne et al. | 606/236 |
| 2012/0012550 | A1 | * | 1/2012 | Boonprasop | 215/11.4 |
| 2013/0102997 | A1 | * | 4/2013 | Abbassmovahedi et al. | 604/514 |

* cited by examiner

BOTTLE NIPPLE DEVICE

FIELD OF THE INVENTION

The present invention is directed to a bottle nipple for infants, more particularly to a thumb-shaped bottle nipple.

BACKGROUND OF THE INVENTION

Some infants prefer to suck on their thumbs rather than suck on pacifiers or standard bottle nipples. The present invention features a bottle nipple device shaped like a thumb. The thumb shape provides infants the appealing texture of a thumb while allowing them to feed. In some embodiments, the thumb-shaped nipple device is featured on a pacifier.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a bottle nipple device shaped like a thumb. In some embodiments, the device comprises a generally circular base having a top surface, a side edge, and a bottom surface; and a thumb-shaped nipple extending upwardly from the top surface of the base, the thumb-shaped nipple is generally hollow and has a top end, wherein a slot is disposed in the top end. The base is adapted to be sandwiched between a top end of a standard bottle a standard bottle cap, the standard bottle cap has a center hole that allows the nipple to protrude outwardly away from the bottle, the slot is fluidly connected to the bottom surface of the base allowing liquid to flow through the base and out of the slot.

In some embodiments, the bottle comprises a hand figurine disposed on an outer surface of the bottle. In some embodiments, the thumb-shaped nipple is mounted on a pacifier base. In some embodiments, the pacifier base comprises a ring.

DESCRIPTION OF PREFERRED EMBODIMENTS

Figure 1:
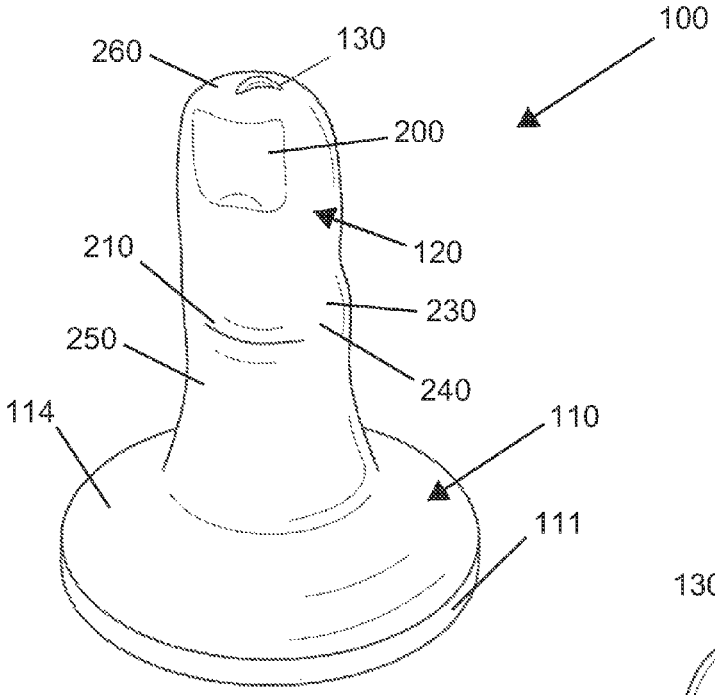
FIG. 1 is a front perspective view of the bottle nipple device of the present invention.
Figure 2:
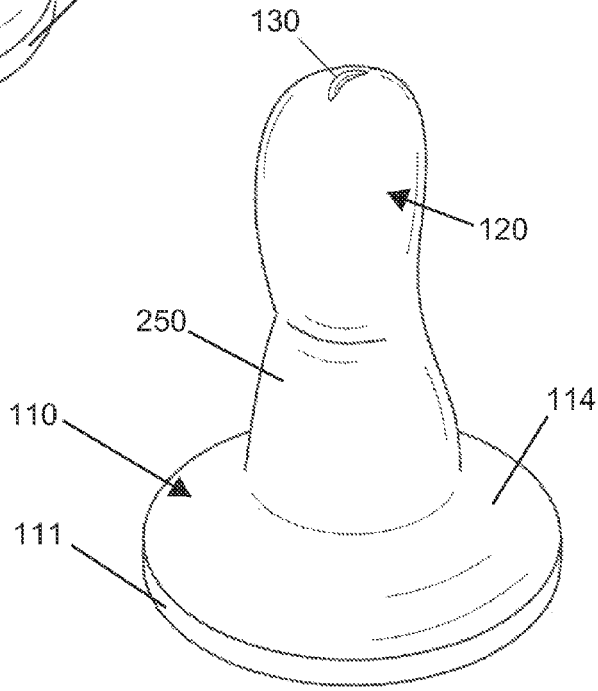
FIG. 2 is a back perspective view of the bottle nipple device of the present invention.
Figure 3:
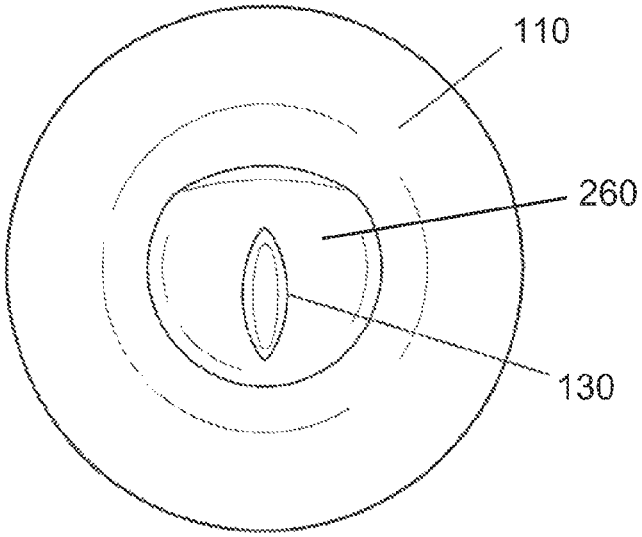
FIG. 3 is a top view of the bottle nipple device of the present invention.
Figure 4:
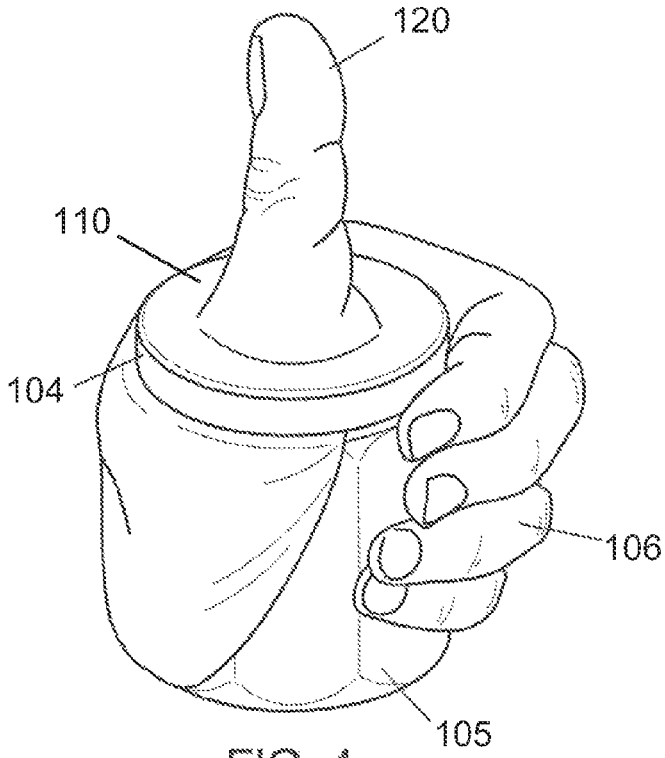
FIG. 4 is a side in-use view of the bottle nipple device of the present invention.

Referring now to FIG. 1-5, the present invention features a bottle nipple device 100 shaped like a thumb. The thumb shape provides infants the appealing texture of a thumb while allowing them to feed.

The nipple device 100 comprises a generally circular base 110 having a top surface 114, a side edge 111, and a bottom surface. The base 110 resembles standard bases found on standard nipples for bottles, which are well known to one of ordinary skill in the art. The base 110 is adapted to be sandwiched between a bottle 105 (e.g., the top end of the bottle) and the bottle cap 104 (the bottle cap 140 has a center hole that allows the nipple to protrude outwardly). Such bottles 105 and bottle caps 104 are well known to one of ordinary skill in the art. In some embodiments, the bottle 105 comprises a hand figurine 106 (in the shape of a hand) disposed on the outer surface of the bottle 105.

Extending upwardly from the top surface of the base 110 is a thumb-shaped nipple 120. The thumb-shaped nipple 120 has a top end 260. In some embodiments, a slot 130 having a pointed oval shape is disposed in an apex of the top end 260. The thumb-shaped nipple 120 is generally hollow. The slot 130 is fluidly connected to the bottom surface of the base 110 allowing liquid to flow from the bottle through the base 110 and out of the slot 130 in the nipple 120. In some embodiments, the thumb-shaped nipple 120 comprises a thumbnail imprint 200. In some embodiments, the thumbnail imprint 200 is adapted to resemble a thumbnail on a human thumb. In some embodiments, the thumb-shaped nipple 120 comprises a knuckle imprint 210. In some embodiments, the knuckle imprint 210 is adapted to resemble a knuckle creases on a human thumb. In some embodiments, the thumb-shaped nipple 120 comprises a bulbous expansion 230 at a midpoint 240 of a side wall 250. In some embodiments, the bulbous expansion 230 is adapted to resemble a knuckle joint on a human thumb.

Figure 5:
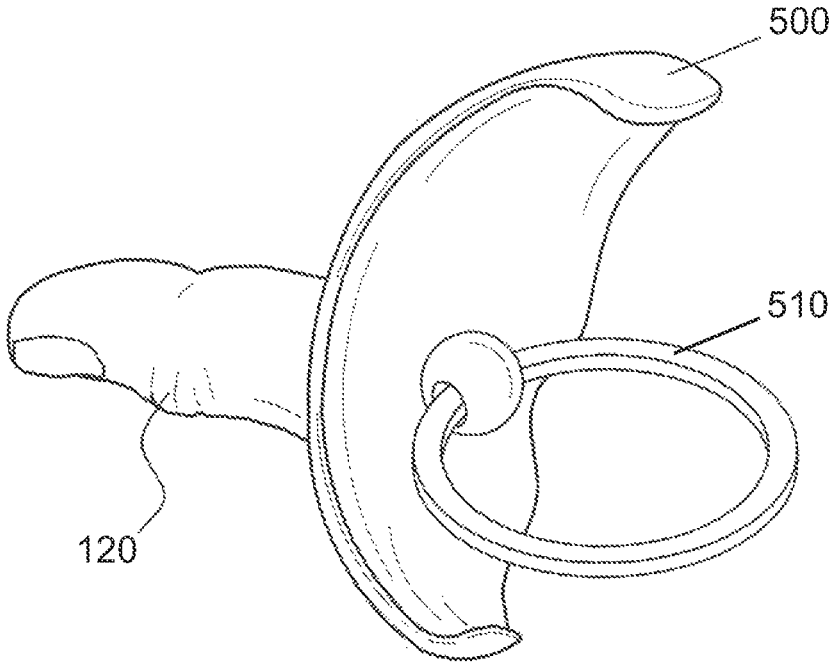
FIG. 5 is an alternative embodiment of the bottle nipple device of the present invention.

In some embodiments, the thumb-shaped nipple device 100 is featured on a pacifier 500 (see FIG. 5). For example, the thumb-shaped nipple 120 is mounted on a pacifier 500. In some embodiments, the thumb-shaped nipple 120 is mounted on and contiguously integrated with a pacifier base 500. In some embodiments, the pacifier 500 comprises a ring.

The disclosures of the following U.S. Patents are incorporated in their entirety by reference herein: U.S. Pat. Application No. 2007/0238063; U.S. Pat. No. 5,275,619; U.S. Pat. No. 7,144,416; U.S. Pat. No. 7,029,491; U.S. Pat. No. 5,133,740; U.S. Design Pat. No. D554,760; U.S. Design Pat. No. D487,929.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A bottle nipple device (100) consisting of:

(a) a generally circular base (110) having a top surface (114), a side edge (111), and a bottom surface; and (b) a thumb-shaped nipple (120) extending upwardly from the top surface (114) of the base (110), the thumb-shaped nipple (120) is generally hollow and has a top end (260), wherein a slot (130) having a pointed oval shape is disposed in an apex of the top end (260), wherein the thumb-shaped nipple (120) comprises a thumbnail imprint (200), wherein the thumbnail imprint (200) is adapted to resemble a thumbnail on a human thumb, wherein the thumb-shaped nipple (120) comprises a knuckle imprint (210), wherein the knuckle imprint (210) is adapted to resemble a knuckle creases on a human thumb, wherein the thumb-shaped nipple (120) comprises a bulbous expansion (230) at a midpoint (240) of a side wall (250), wherein the bulbous expansion (230) is adapted to resemble a knuckle joint on a human thumb;

wherein the base (110) is adapted to be sandwiched between a top end of a standard bottle (105) and a standard bottle cap (104), the standard bottle cap (140) has a center hole that allows the thumb-shaped nipple (120) to protrude outwardly away from the bottle (105), the slot (130) is fluidly connected to the bottom surface of the base (110) allowing liquid to flow through the base (110) and out of the slot (130).

* * * * *